United States Patent [19]

Martinez

[11] Patent Number: 4,952,191

[45] Date of Patent: Aug. 28, 1990

[54] TUMBLING TOY

[76] Inventor: Gabriel A. Martinez, 11229 Columbia Pike, White Oak, Md. 20901

[21] Appl. No.: 321,189

[22] Filed: Mar. 9, 1989

[51] Int. Cl.[5] ..... A63H 15/00

[52] U.S. Cl. ..... 446/324; 446/268

[58] Field of Search ..... 446/3, 129, 131, 132, 446/139, 168, 169, 268, 269, 273, 324, 325, 326, 396

[56] References Cited

U.S. PATENT DOCUMENTS

| | | | |
|---|---|---|---|
| 622,354 | 4/1899 | Harvey | 446/324 X |
| 669,498 | 3/1901 | Aiken . | |
| 800,741 | 10/1905 | Howard | 446/269 |
| 1,155,692 | 10/1915 | Vie-Theer . | |
| 1,214,454 | 1/1917 | Gowdey . | |
| 1,254,428 | 1/1918 | Myers | 446/324 |
| 1,272,588 | 7/1918 | White . | |
| 1,282,724 | 10/1918 | Anderson | 446/324 X |
| 1,383,316 | 7/1921 | Liebert | 446/168 |
| 1,538,704 | 5/1925 | Kay . | |
| 1,672,242 | 6/1928 | Bennett . | |
| 2,218,207 | 10/1940 | Herzinger . | |
| 2,585,780 | 2/1952 | Johnson | 446/324 X |
| 2,751,707 | 6/1956 | Kask . | |
| 4,151,676 | 5/1979 | Clark | 446/325 |
| 4,314,422 | 2/1982 | Wexler | 446/269 |

FOREIGN PATENT DOCUMENTS

| | | | |
|---|---|---|---|
| 338411 | 6/1921 | Fed. Rep. of Germany | 446/324 |
| 488746 | 1/1930 | Fed. Rep. of Germany | 446/139 |
| 2248319 | 4/1974 | Fed. Rep. of Germany | 446/269 |
| 624792 | 7/1927 | France | 446/324 |
| 267135 | 6/1950 | France | 446/324 |
| 76698 | 6/1918 | Switzerland . | |
| 2014462 | 8/1979 | United Kingdom | 446/324 |

*Primary Examiner*—Robert A. Hafer
*Assistant Examiner*—Sam Rimell
*Attorney, Agent, or Firm*—Banner, Birch, McKie & Beckett

[57] ABSTRACT

A tumbling toy including a housing forming a head portion, a ball disposed in the housing and a body portion being substantially more flexible than said housing and extending therefrom. A mechanism is formed in the housing for permitting the ball to pass into the housing while substantially restricting the ball from passing therethrough in the opposite direction. The toy also includes a layer of gripping material for preventing the toy from sliding on an incline without tumbling.

19 Claims, 1 Drawing Sheet

TUMBLING TOY

TECHNICAL FIELD

The present invention relates to a tumbling toy, and more particularly to a tumbling figure toy which will tumble end-over-end down an incline while executing amusing movements.

BACKGROUND OF THE INVENTION

Heretofore, tumbling figure toys which tumble end-over-end when placed on a duly inclined surface have included a cylinder containing a ball or sphere. The ball rolls to the respective ends or heads of the cylinder due to the effect of gravity wherein the impactive reception of the ball in the heads produces the tumbling motion. The cylinder may be constructed or designed as the head portion of the toy, while flexible cloth or fabric may be attached to the cylinder to construct the remaining portion of the toy body or torso.

Open-ended cylinders have been used in prior art tumbling dolls wherein the open ends of a respective cylinder are covered with cloth to retain the ball therein. The prior art also discloses forming a generally imperforate cylinder around the ball. In the former case, the cloth forms the mechanism for transferring the kinetic energy of the ball to the cylinder. The cloth, not being very rigid, may not provide optimum energy transfer to the cylinder. Furthermore, children may readily remove the cloth to gain access to the ball. Such access may render the toy unsafe to children who may, for example, place the ball in their mouths and inadvertently swallow the same. The imperforate type cylinders, or double-ended cylinders, may have flat heads at each end of the cylinder. The flat head design merely affords a single point contact when the ball impacts the head. Such minimal impact area may not provide optimum kinetic energy transfer from the ball to the cylinder. Furthermore, an additional sealing step to seal the ball in the cylinder may be necessary to manufacture the double-ended ball-containing cylinder. Finally, prior art tumbling figure toys, such as the tumbling toy disclosed in U.S. Pat. No. 1,155,692 to Vie-Theer, may slide and not tumble down the incline if the angle of inclination is not suitable.

SUMMARY OF THE INVENTION

In view of the above and other deficiencies of the known prior art, it is the object of the present invention to provide a tumbling toy having a prefabricated ball housing that includes a mechanism for inserting the ball or sphere in the prefabricated housing and retaining the same therein without requiring additional steps to seal the ball or sphere in the housing, thereby eliminating assembly steps and reducing manufacturing costs.

It is another object of the present invention to optimize kinetic energy transfer from the gravitationally excited ball to the ball housing to maximize tumbling movement of the toy.

It is yet another object of the present invention to provide a tumbling toy having a ball housing wherein the ball is difficult to remove, thereby improving the child safety factor.

It is still another object of the present invention to provide a tumbling toy with a gripping surface to prevent the toy from sliding down the incline without tumbling due to incline angle or incline surfaces having a low coefficient of friction such as glass.

It is yet a further object of the present invention to provide a tumbling toy capable of tumbling along vertical surfaces.

Thus, the invention involves a tumbling toy comprising a housing forming a head portion, a ball disposed in the housing and a body portion being substantially more flexible than the housing and extending therefrom. The toy may include a mechanism for permitting the ball to pass into the housing while substantially restricting the ball from passing therethrough in the opposite direction and/or a layer of gripping material bonded to a portion of the outer surface of the toy. The gripping material has a coefficient of friction greater than that of the outer surface of the toy and prevents the toy from sliding down an incline without tumbling.

DETAILED DESCRIPTION OF THE PREFERRED EMBODIMENTS

Figure 1:
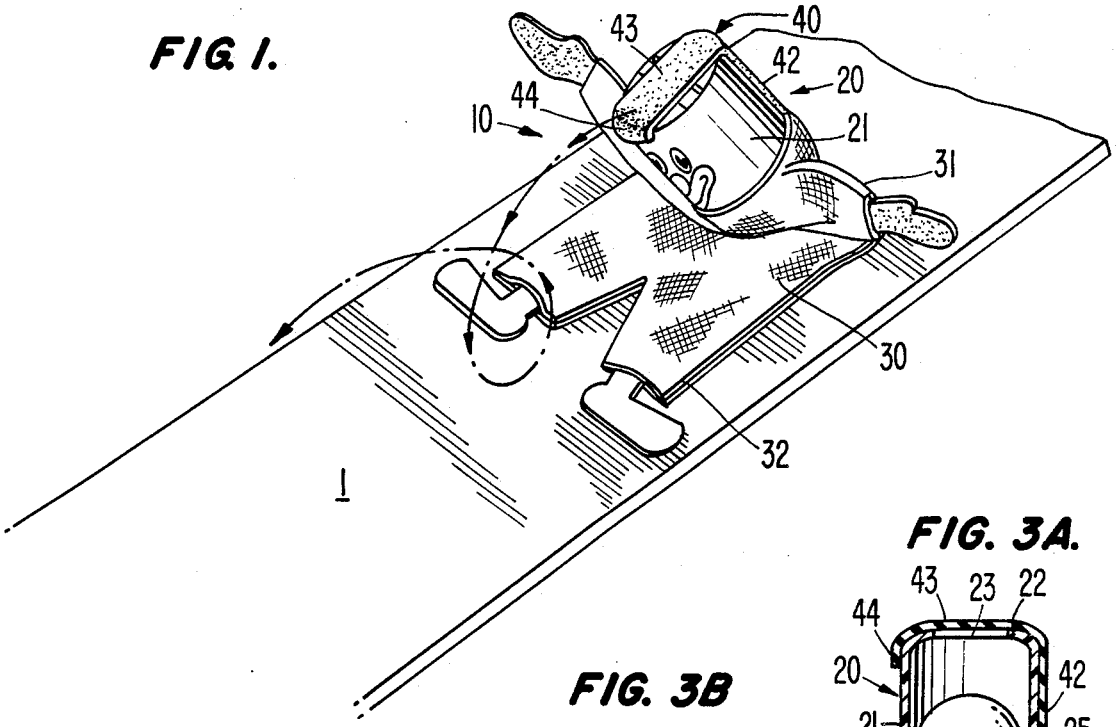
FIG. 1 is a perspective view of the tumbling toy tumbling down an incline in accordance with a preferred embodiment of the present invention.

Referring to the drawings in detail, wherein like numerals indicate like elements, FIG. 1 shows a tumbling toy tumbling down incline 1 in accordance with a preferred embodiment of the present invention. Preferably, tumbling toy 10 is constructed in the simulation of a figure, such as a clown, elf, gnome, goblin or other creature, or personage. Accordingly, the outer portion of ball housing 20 which forms the head portion of the doll, may be printed, engraved, drawn or painted upon to represent a face. Furthermore, the lower portion or main body portion 30 of the tumbling toy may include flexible arms 31 and legs 32 extending therefrom. Main body portion 30 and legs 32 preferably are flat or constructed in such a manner so that they will readily fold upon themselves and against head portion 20 and not interfere with the tumbling motion of head portion 20. Accordingly, body portion 30 should be substantially more flexible than head portion 20 and may be made from any suitable cloth or fabric, or plastic.

Figure 3A:
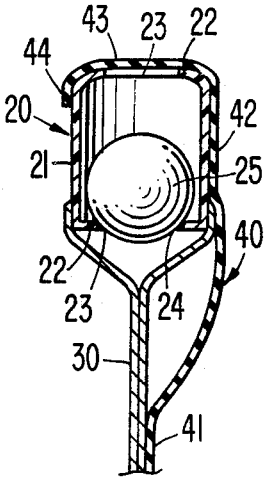
FIG. 3A is a partial cross-sectional view of the tumbling toy of FIG. 1 taken along line 3—3 of FIG. 2.
Figure 3B:
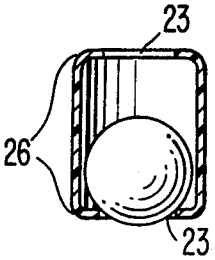
FIGS. 3B, C, D and E illustrate cross-sectional views of further embodiments of the ball housing.

Referring to FIG. 3A, ball housing 20 comprises shell 21 and annular heads 22. Annular heads 22 are formed at opposite ends of shell 21 for retaining weighted ball 25 therein and forming an impact surface therewith. Housing 20 is shown as being cylindrical. However, other configurations may be used. Furthermore, any of the disclosed ball housings, including those discussed hereafter, may include a rounded edge at the interface of the shell and head as illustrated in FIG. 3B at 26. The rounded edges enable the housing to more freely tumble end-over-end and also improve the child safety factor.

Returning to FIG. 3A, the inner annular surface of head 22 forms seat 24 for cooperation with weighted ball 25. This head construction including the annular seating surface of seat 24 is preferred over a generally imperforate flat head because the flat head would merely provide a point contact with ball 25. In contrast to the flat head, annular seat 24 provides an annular surface area for contact with ball 25. The increased contact area afforded by the annular configuration reduces rebound effect and increases kinetic energy transfer efficiency from ball 25 to housing 20. The inner annular surface of head 22 also forms aperture 23. Aperture 23 is sized to have a slightly smaller diameter than ball 25 to restrict the free entry of the ball therethrough. However, the material of annular head 22 is selected to exhibit sufficient flexibility to enable ball 25 to elastically deform head 22, pass through aperture 23 and enter prefabricated housing 20 when sufficient force is applied to ball 25. Furthermore, once ball 25 is disposed in housing 20, it is difficult to access the ball to apply an appropriate force thereto to remove ball 25 from housing 20 through aperture 23. In this sense, housing 20 comprises a one-way safety mechanism which permits ball 25 to pass into the housing, while substantially limiting ball 25 from being removed therefrom, thereby substantially limiting the danger of having a small ball in the hands of a child who may, for example, swallow the same.

Figures 3C, 3D, 3E:
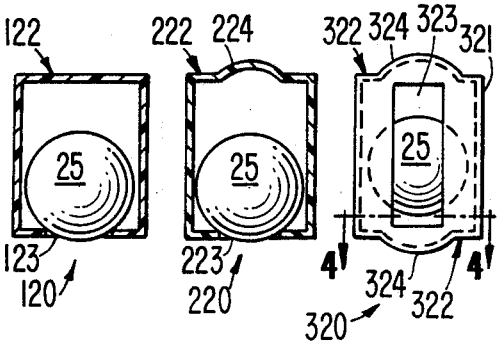

FIGS. 3C and 3D illustrate the aperture of the above-described one-way mechanism being located at only one end of the ball housing. These embodiments make it even more difficult to remove the ball from the ball housing. Specifically, heads 122 and 222, disposed at one end of the housing 120 or 220, lack an aperture as described above or are substantially imperforate. Accordingly, heads 122 and 222 virtually prevent the passing of an object therethrough which could be used to force ball 25 out of housing 120 or 220 through aperture 123 or 223. Housing 120 includes head 122 having a substantially flat configuration which enables housing 120 to tumble along a substantially straight path. Housing 220 includes head 222 having a curved portion or seat 224. Seat 224 has an inner surface having a curvature corresponding to the curvature of the outer surface of ball 25 to increase the contact surface between ball 25 and head 222. Accordingly, seat 224 improves kinetic energy transfer from the ball to the housing when compared to the flat head of housing 120, but seat 224 may cause the toy to tumble away from a straight path.

Figure 4:
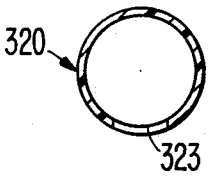
FIG. 4 is a transverse cross-sectional view taken along line 4—4 of the ball housing depicted in FIG. 3E.
Figure 5:
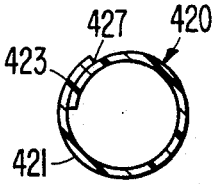
FIG. 5 is a transverse cross-sectional view of a ball housing showing yet another embodiment of the one-way mechanism.

FIGS. 3E, 4 and 5 illustrate further embodiments of the aperture of the above-described one-way mechanisms. These apertures are shown as being formed in the shell of the ball housing. Alternatively, these apertures may be formed in either one or both of its housing heads. Referring to FIG. 3E, ball container 320 includes aperture 323 formed in shell 321. Aperture 323 may be generally rectangular and positioned with its longest side or leg running parallel with the longitudinal axis of housing 320, as shown in FIGS. 3E and 4. At least the width of rectangular aperture 323 is sized to be less than the diameter of ball 25 to restrict the free entry of the ball therethrough. However, the material or shell 321 is selected to exhibit sufficient flexibility to enable ball 25 to elastically deform shell 321, pass through aperture 323 and enter prefabricated housing 320 when sufficient force is applied to ball 25. As can be seen while viewing FIG. 3E, the opposite ends of shell 321 are closed by heads 322. Heads 322 are shown as including curved portions or seats 324 similar to seat 224. Alternatively, they may have a flat configuration like head 122. Furthermore, the longer side or leg of aperture 323 may be oriented at any angle with respect to the longitudinal axis of housing 320. Finally, it should be noted that apertures 23, 123, 223 and 323 may have other shapes, such as triangular, square pentagonal and so forth, which would provide a similar one-way passage when in conbination with the housing without departing from the scope or spirit of the present invention.

Referring to FIG. 5, the one-way mechanism includes a flap valve formed in shell 421 of housing 420. The length of overlap seam 427 of flap valve 423 is sized to permit ball 25 to pass through the flap valve upon elastic deformation thereof and enter prefabricated housing 420. Housing 420 may include heads at opposite ends thereof having curved portions or seats similar to head seats 224 or 324 formed in either or both of the heads. Alternatively, the flap valve may be formed in either head as opposed to the shell.

Figure 2:
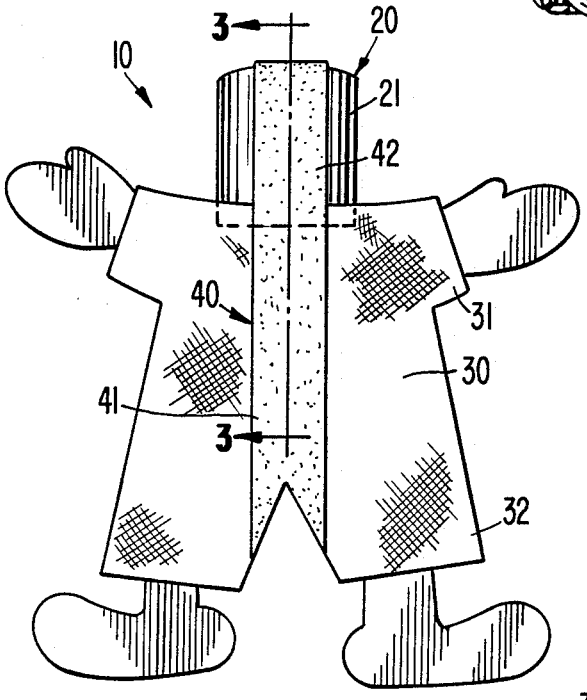
FIG. 2 is a backside plan view of the tumbling toy of FIG. 1.

Returning to FIGS. 1, 2 and 3A, tumbling toy 10 may also include gripping material or element 40 having a relatively high coefficient of friction to prevent the toy from sliding down the incline without tumbling due to the incline angle or an incline surface having a low coefficient of friction. Accordingly, the gripping element should have a coefficient of friction substantially greater than the outer surface of the toy. Gripping element 40 may be in the form of a strip including first portion 41 extending along legs 32 and the back of body portion 30, second portion 42 extending in a longitudinal direction on an outer surface of the ball housing shell or the toy head portion, third portion 43 extending over an end of the housing distal from body portion 30, and fourth portion 44 overlapping the joint between the housing shell and head and extending partially along the shell toward body portion 30. Portions 42, 43 and 44 form an L-shaped configuration and enable the head portion to grip the incline surface and tumble without sliding thereon, while first portion 41 prevents body portion 30 from sliding. The gripping element may have other configurations and may cover other portions of the tumbling toy such as the hands or feet which extend from arms 31 and legs 32, respectively. Gripping element 40 may comprise a strip of elastomeric material or any other material having a surface with a suitable coefficient of friction. For example, gripping element 40 may be selected from natural or synthetic rubbers and may comprise polymers of conjugated dienes such as polybutadiene or polyisoprene or hydrogenated versions or derivatives thereof. Furthermore, the material may include copolymers of butadiene or isoprene with themselves, other conjugated dienes, or other monomers, such as styrene. The strip may be secured to the toy by any suitable means such as an adhesive. Alternatively, a liquid, gel or plastic comprising elastomeric material in a solution with a solvent and optionally with cross-linking agents, may be applied to the toy. After setting and bonding with the base surface of the toy, the liquid, gel or paste produces the desired surface.

Weighted ball 25 preferably is magnetic so that the toy may be used on very steep inclines, including vertical inclines, when the incline surface material is capable of attracting a magnet. However, weighted ball 25 may be made from glass, rubber, metal or any other suitable material.

Having described the invention in detail, it will be recognized that the foregoing is considered as illustrative only of the principles of the invention. Since numerous modifications and changes will readily occur to those skilled in the art, it is not desired to limit the invention to the exact construction, materials, assembly and so forth shown and described. Accordingly, all suitable modifications and equivalents may be resorted to the extent they fall within the scope of the invention and claims appended hereto.

I claim:

1. A tumbling toy comprising a substantially rigid housing forming an upper end portion of said toy, a ball disposed in the housing and a body portion being substantially non-rigid and extending therefrom, said toy including a layer of material bonded to a portion of the outer surface of said toy and having a coefficient of friction greater than that of said outer surface, said housing comprising means for permitting the ball to pass into the housing while restricting the ball from readily passing therethrough in the opposite direction.

2. The tumbling toy of claim 1 wherein said means comprises at least one aperture formed in a wall of said housing.

3. The tumbling toy of claim 2 wherein said housing comprises a shell and a head at each end thereof, said aperture being formed in one of said heads.

4. The tumbling toy of claim 3 wherein said aperture has a diameter less than the diameter of said ball.

5. The tumbling toy of claim 4 wherein each head includes one of said apertures.

6. The tumbling toy of claim 4 wherein the other head includes a curved portion having a curvature corresponding to the curvature of the ball for cooperation therewith.

7. The tumbling toy of claim 2 wherein said housing comprises a shell and a head at each end of said shell, said aperture being formed in said shell.

8. The tumbling toy of claim 7 wherein said aperture is rectangular.

9. The tumbling toy of claim 7 wherein at least one head includes a curved portion having a curvature corresponding to the curvature of the ball for cooperation therewith.

10. The tumbling toy of claim 7 wherein each head includes a curved portion having a curvature corresponding to the curvature of the ball for cooperation therewith.

11. The tumbling toy of claim 1 wherein said first means comprises a flap valve formed in a wall of said housing.

12. The tumbling toy of claim 1 wherein said ball is magnetic.

13. A tumbling toy comprising a substantially rigid housing, forming an upper end portion of said toy, a ball disposed in the housing, a body portion having front and back sides, being substantially non-rigid and extending therefrom, and gripping means for preventing the toy from sliding on an incline without tumbling, said gripping means comprising a layer of material having a coefficient of friction greater than that of the outer surface of said body portion back side and being bonded to at least a portion thereof.

14. The tumbling toy of claim 13 wherein said gripping means comprises a strip of elastomeric material.

15. The tumbling toy of claim 14 wherein said elastomeric strip extends along an outer surface of said housing in a longitudinal direction thereof, over an end of the housing distal from said body portion and along a portion of the housing in a direction toward said front side of said body portion.

16. The tumbling toy of claim 13 wherein said gripping means covers the major area of the back surface of said body portion.

17. A tumbling toy comprising a substantially rigid housing forming an upper end portion of said toy, a ball disposed in the housing and a body portion having front and back sides, being substantially non-rigid and extending therefrom;

first means for permitting the ball to pass into the housing while substantially restricting the ball from passing therethrough in the opposite direction; and gripping means for preventing the toy from sliding on an incline without tumbling, said gripping means comprising a layer of material having a coefficient of friction greater than that of the outer surface of said body portion back side and being bonded to at least a portion thereof.

18. The tumbling toy of claim 17 wherein said first means is elastically deformable.

19. The tumbling toy of claim 18 wherein said first means comprises at least one aperture formed in a wall of said housing.

* * * * *